United States Patent [19]

Akre

[11] 3,985,341

[45] Oct. 12, 1976

[54] WINCH-TYPE TENSIONING DEVICE

[76] Inventor: Ivar J. Akre, 1436 E. 3150 South, Salt Lake City, Utah 84106

[22] Filed: May 23, 1975

[21] Appl. No.: 580,340

[52] U.S. Cl. ..... 254/161; 188/77 R

[51] Int. Cl.[2] ..... A63B 61/04

[58] Field of Search ..... 254/198, 161, 164, 162; 242/99, 107 R; 24/68 R, 69 CT, 69 ST, 69 WT, 71 ST, 127; 188/77 R

[56] References Cited

UNITED STATES PATENTS

| | | | |
|---|---|---|---|
| 484,042 | 10/1892 | Murphy et al. | 188/77 R |
| 584,625 | 6/1897 | Cronin | 188/77 R |
| 692,684 | 2/1902 | Loewenstein | 188/77 R |
| 2,065,577 | 12/1936 | Gladstone | 254/161 |
| 2,168,954 | 8/1939 | Jacob et al. | 254/161 |
| 2,464,832 | 3/1949 | Stuart | 254/161 |

*Primary Examiner*—Robert J. Spar
*Assistant Examiner*—Kenneth Noland
*Attorney, Agent, or Firm*—Mallinckrodt & Mallinckrodt

[57] ABSTRACT

An improved winch-type device for establishing and maintaining tension in a tie rope, cord, or cable is disclosed. The novel device is self-locking and does not require a ratchet or other locking mechanisms as used in convention winch devices. The device comprises a reel consisting of two end discs which are joined together at their centers by a spindle, i.e., an elongate shaft. The end discs of the reel are supported by a pair of bearing members in which the bearing faces thereof substantially enclose and make sliding contact with the perimeters of the respective discs. The bearing members are interconnected by a connecting member extending from one of the bearing members to the other so as to hold the bearing members in fixed position about the respective discs. A crank member is associated with one of the end discs for rotating the reel within the bearing members. Means are provided for attaching a tie rope, cord, or cable to the spindle of said reel so that the rope, cord, or cable can be wrapped around the spindle when the reel is rotated, to establish and maintain tension in the rope, cord, or cable. Frictional forces developed between the end discs of the reel and the bearing members render the tensioning device of this invention self-locking, i.e., after the reel has been rotated by the crank member to develop tension in the rope, cord, or cable attached thereto, the crank member can be released and the reel will remain stationary, thereby maintaining tension in the rope, cord, or cable.

7 Claims, 5 Drawing Figures

WINCH-TYPE TENSIONING DEVICE

BACKGROUND OF THE INVENTION

1. Field

The invention pertains to devices for establishing and maintaining tension in a tie rope, cord, or cable, and, more particularly, to such devices which utilize a winch or rotating reel to remove slack and develop tension in the tie rope, cord, or cable.

2. State of the Art

Winches and windlasses have long been used in hauling and raising objects. Motor driven winches are well known in various applications where a heavy object is to be moved or raised. Hand-operated winches are commonly used for pulling and moving articles. Hand-operated winches are used extensively for pulling items such as boats, snowmobiles, etc., onto trailers. Hand operated winches have also been suggested for use as clothesline tighteners (see U.S. Pat. Nos. 2,456,115 and 2,626,763).

If a winch is to maintain tension in the rope, cord, or cable attached thereto, a constant force must be applied to the reel upon which the rope, cord, or cable is wound, to prevent the reel from unwinding due to the moment, or torque, exerted on the reel by the tension in the rope, cord, or cable. Heretofore, winches have been provided with ratchets or other braking mechanisms to prevent the undesired unwinding movement of the reel. The present invention provides a simplified winch-type device which is self-locking and does not require the ratchets or other braking mechanisms used in the prior art.

SUMMARY OF THE INVENTION

This invention provides an easy-to-use, winch-type device which is used in establishing and maintaining tension in a tie rope, cord, or cable. The device is self-locking, i.e., it does not require a ratchet or other braking mechanism to lock the device while tension is maintained in the rope, cord, or cable.

The device comprises a reel, e.g., spool, consisting of two end discs which are joined together at their centers by a shaft, e.g., a spindle. The reel is supported by a pair of bearing members, the bearing faces of which respectively encompass and make sliding contact with a sufficient portion of the perimeters of the end discs to hold the end discs in position for sliding rotational movement within the bearing members.

The bearing members are rigidly connected together by a connecting member which holds the respective bearing members in fixed position around the end discs. The connecting member preferably forms a yoke extending from the perimeter of one bearing member to the corresponding perimeter of the other bearing member.

In a preferred form of the device, the bearing members comprise elongate tracks which are bent back upon themselves, respectively, to form circular loops. The internal surfaces of the so-formed loops comprise the bearing faces which encompass and make sliding contact with the perimeters of the end discs. The ends of the tracks extending from the so-made circular loops are attached, respectively, to the connecting member, and the connecting member holds the circular loops in fixed position around the end discs.

The bearing faces of the bearing members are preferably adapted to provide lateral support to the end discs of the reel, thereby restraining the reel from lateral movement with respect to the bearing members. A flange can be provided at the edges of the respective bearing faces extending along at least a portion of the lateral sides of the end discs. Alternatively, the bearing faces can have a concave surface with the perimeters of the end discs being adapted to engaging the bearing faces for rotational sliding movement, while simultaneously being restrained from lateral movement relative to the bearing faces.

A cranking means is associated with the discs for rotating the reel within the bearing members, and means are provided for attaching a tie rope, cord, strap, or cable to the reel so that when the reel is rotated, the rope, cord, strap, or cable is wound around the shaft of the reel. Wrapping of the rope, cord, strap, or cable around the shaft of the reel first takes up slack and then establishes a tension in the rope, cord, strap, or cable.

It has been found that when the reel of the device is properly sized, friction developed between the end discs and the bearing faces of the bearing means is sufficient to prevent the reel from unwinding after tension has been established in the rope, cord, strap, or cable attached to the reel. The tension developed in the rope, cord, strap, or cable produces a normal force between the end discs of the reel and the bearing faces substantially equal to the tension developed therein. The normal force develops a resulting frictional force between the discs of the reel and the bearing members. In winding the reel to increase tension in the rope, cord, strap, or cable, the frictional force is overcome by the cranking force exerted on the reel by the cranking means. But, when the cranking force is removed, the reel remains stationary and will not unwind. The torque on the reel due to the frictional force produced between the end discs of the reel and the bearing members is greater than the torque due to the tension in the rope, cord, strap, or cable, and the reel is, thus, locked in place. It has been found that the self-locking nature is achieved when the end discs are sized such that they have a radius which is at least about 2.5 times the sum of the radius of the shaft connecting the end discs and the diameter of the rope, cord, strap, or cable which is wound on the reel.

Preferably, the end discs have a diameter at least about 2.5 times the sum of the shaft of the reel and twice the diameter of the tie rope, cord, strap, or cable, thus allowing the device to take up slack in the rope, cord, strap, or cable to an extent that a double winding of the rope, cord, strap, or cable can be made on the reel of the device. It should be noted, that if too many windings are taken on the reel, the device no longer is self-locking. It has been found that the self-locking feature is lost when the windings are built up on the reel to where the radius of the windings is about one-half the radius of the end discs.

A preferred means of attaching the rope, cord, strap, or cable to the reel allows the excess slack to be taken out of the rope, cord, strap, or cable without winding the slack up on the reel. An opening is provided in one of the end discs of the reel. The opening is positioned adjacent the point where the elongate shaft is attached to the end disc. The free end of the tie rope, cord, strap, or cable is inserted through the opening from the inside of the reel. The excess slack in the rope, cord, strap, or cable is pulled through the opening and the reel is then rotated with the cranking means to wrap the rope, cord, strap, or cable on the reel, thereby establishing tension therein.

The device of this invention can be attached permanently to the item to which the tie rope, cord, strap, or cable is to be secured. For example, the device can be permanently attached to the sides of a trailer or truck to secure and maintain tension in tie ropes, straps used in tying down the load to be carried by the trailer or truck. Alternatively, the device can be adapted for removable attachment to the item to which the tie-down rope is to be secured. In such case, means are provided for releasable securing the device to the base or support to which the tie-down rope is to be anchored.

THE DRAWING

The device illustrated in the accompanying drawings represent the best mode presently contemplated of carrying out the invention, although it is recognized that the inventive concepts here taught can be utilized in a variety of specific forms within the scope of the claims.

DETAILED DESCRIPTION OF THE PREFERRED EMBODIMENT

Figure 1:
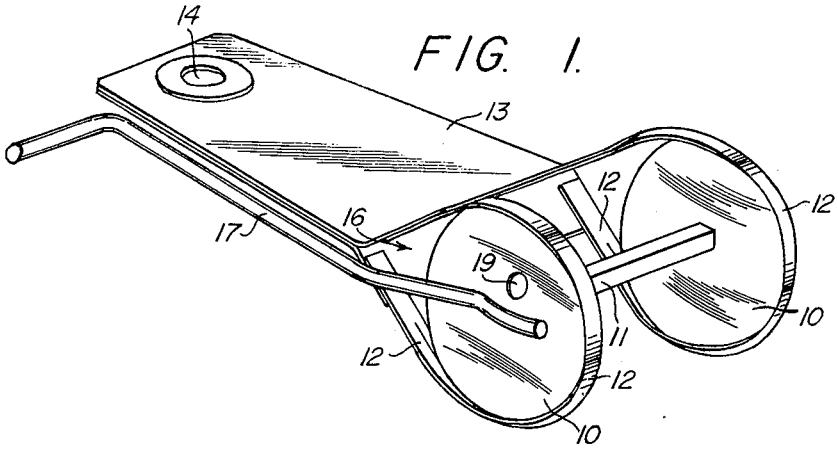
FIG. 1 is a perspective of a preferred embodiment of the device of the invention.

As illustrated in the drawings, a preferred form of the device comprises a reel consisting of two end discs 10 which are joined together by an elongate shaft 11 extending from the center of one disc 10 to the center of the other disc 10. The reel is supported by bearing members for rotational movement about the longitudinal axis of shaft 11. The bearing members comprise elongate tracks 12 which are bent back upon themselves, respectively, to form circular loops. The inward facing surfaces of the circular loops form bearing faces which encompass and make sliding contact, respectively, with a sufficient portion of the perimeters of the end discs 10 so that the discs 10 are retained within the loops formed by the respective tracks 10 for sliding rotational movement with respect thereto.

Figure 4:
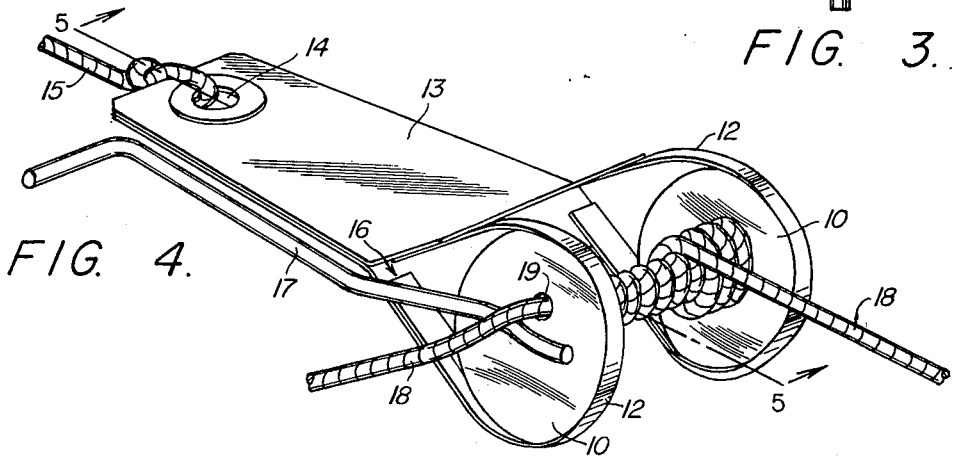
FIG. 4 is a perspective view of the device shown in FIG. 1 showing a tie down rope wound on the reel of the device, and an anchoring rope tied to the yoke of the device.
Figure 5:
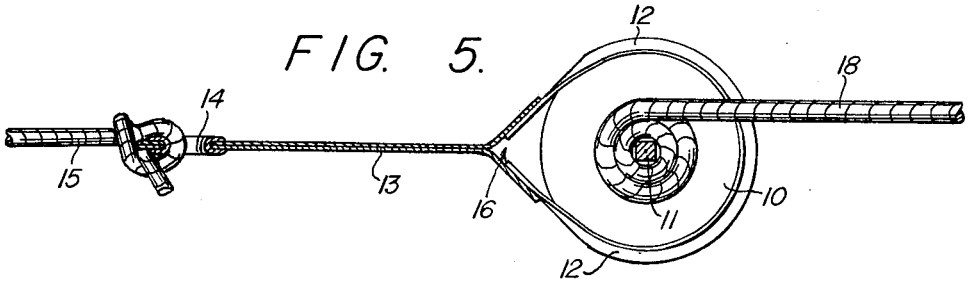
FIG. 5 is a cross-sectional view taken along section 5—5 of FIG. 4.

Tracks 12 are held in fixed position with respect to each other and about the discs 10 by a connecting member. As shown in the drawings, the connecting member comprises a flat yoke member 13 formed from two thin, flat sheets laminated together to form a flat plate. One end of yoke member 13 has an opening 14 therein through which a rope 15 can be inserted and tied to the yoke member 13 as shown in FIGS. 4 and 5. The rope 15 is used to removably attach the device to a base or support (not shown in drawings). At the other end of yoke member 13, the two thin flat sheets are bent away from each other forming a V shaped trough 16 running lengthwise along the edge of the yoke member. The ends of tracks 12 are integrally attached to the respective ends of the portions of the two flat sheets which form the V shaped trough 16, so that the tracks 12 extend, respectively, from one of the flat sheets, around the respective end discs 10 to the other flat sheet, with the end discs 10 being cradled in the trough 16.

Figure 2:
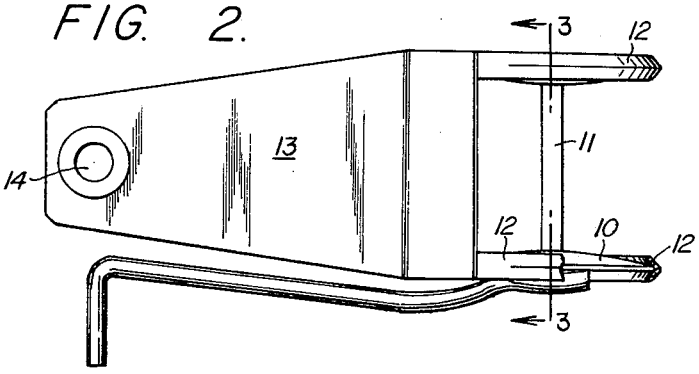
FIG. 2 is a top plan view of the device shown in FIG. 1.
Figure 3:
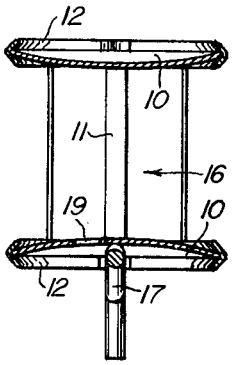
FIG. 3 is a cross-sectional view taken along section 3—3 of FIG. 2.

The edges of tracks 12 are adopted to provide lateral support to the respective end discs 10 thereby restraining the reel from lateral movement with respect to the tracks 12 and yoke member 13. As shown, the portion of the bearing faces of tracks 12 which make contact with the perimeters of end discs 10 are concave (best shown in FIGS. 2 and 3); and the peripheral edges of end discs 10 are adapted to be received within the concave faces so as to constrain the end discs 10 to rotational movement only with respect to tracks 12. Instead of having concave bearing faces as illustrated, the respective bearing members could have planar bearing faces which contact the periphery of end discs 10. Means would then have to be provided to restrain the end discs from lateral movement with respect to the bearing members. For example, the bearing members could have flanges extending therefrom so that the flanges of the respective bearing members are adjacent at least a portion of the outside edges respectively of end discs 10.

A crank handle 17 is attached to one of the end discs 10 of the reel thereby providing means for cranking or rotating the reel about its longitudinal axis through the shaft 11. Means are provided for attaching a rope, cord, strap or cable to the reel so that the rope, cord, strap or cable can be around the shaft 11 as the reel is cranked or rotated, thereby taking up slack and establishing tension in the rope, cord, strap or cable. As illustrated, a preferred means for attaching the rope, cord, strap or cable comprises an opening 19 in one of the end discs 10 adjacent the shaft 11. As shown in FIG. 4, a tie rope 18 is threaded through opening 19 from the inside of the reel to the outside. The rope 18 is pulled so as to take out as much slack as possible therein, and the crank handle 17 is then rotated thereby wrapping the rope around the shaft 11 (FIGS. 4 and 5).

The shaft 11 can have any cross-sectional shape. The square cross-sectional shape, as shown in the drawings, has been found to be advantageous in gripping and holding the wraps of rope, cord, or cable tightly on the shaft. It has also been found advantageous to apply a lubricant, either oil or grease, to the bearing faces which contact the periphery of the end discs 10. The lubricant allows the end discs 10 to rotate with uniform movement, and the device is still found to be self-locking.

The self-locking feature of the apparatus of this invention is produced by the frictional forces developed between the end discs 10 and the bearing members in which they rotate. Referring to FIG. 5, it can be seen that the tension developed in rope 18 forces the end discs 10 against the bearing faces of the tracks 12 with a force equal to the tension in the rope. For purposes of this discussion it is assumed that the tension developed in rope 18 is exerted through only one end disc. In reality it is exerted equally through both end discs, but the total resulting frictional force developed by both end discs would be the same as in our theoretical case wherein all the force is exerted through just one of the end discs. The frictional force developed between the end disc 10 and the bearing face of track 12 is equal to the coefficient of static friction times the force or the tension in the rope. The frictional force acts tangentially of the end disc 10 and produces a torque on the reel equal to the frictional force times the radius of the end disc 10. This frictional torque opposes the torque produced by the tension in the rope itself. The torque produced by the rope is equal to the tension therein times the distance from the center of disc 10 to the last wrapping of rope on shaft 11 (as shown in FIG. 5, the torque produced by rope 18 is equal to the tension therein times the sum of the radius of shaft 11 and twice the diameter of the rope 18).

For the device to be self-locking, the opposing torques being exerted on the reel must be equal. This is shown in the mathematical equation:

$$u\,T\,r = Te$$

wherein $u$ is the coefficient of static friction, $T$ is the tension in the rope, $r$ is the radius of the end disc 10, and $e$ is the effective distance from the center of the end disc 10 to the outer wrapping of rope on shaft 11. Solving this equation for $r$, the required radius of end discs 10, gives:

$$r = e/u$$

The value of $u$ varies with respect to the materials from which the end discs 10 and the bearing faces are made. A good approximation of $u$ for the present application is about 0.4, and it has been found, for practical purposes, that the end discs 10 should have a radius of at least about 2.5 times the effective distance $e$. As an illustration, if the rope and the shaft 11 shown in FIG. 5 each has a diameter of ¼ inch, the radius of the end discs 10 would have to be at least about the sum of the radius of the shaft 11 plus twice the diameter of the rope, or approximately 1.56 inches.

Generally, sufficient slack can be removed from the rope 18 by pulling it through opening 19 prior to rotating the reel, whereby sufficient tension can be developed in the rope with only one winding of rope being taken on shaft 11. If only one winding of rope were to be made on shaft 11 of the device shown in FIGS. 4 and 5, the minimum radius of the end discs 10 would be equal to 2.5 times the sum of the radius of shaft 11 plus the diameter of the rope 18, or approximately 0.9375 inch.

Whereas there is here illustrated and specifically described a certain preferred construction of apparatus which is presently regarded as the best mode for carrying out the invention, it should be understood that various changes can be made and other constructions adopted without departing from the inventive subject matter particularly pointed out and claimed in the following claims.

I claim:

1. A winch-type device for establishing and maintaining tension in a tie rope, cord, strap, or cable, said device comprising a reel formed by two end discs which are jointed together by an elongate shaft extending from the center of one disc to the center of the other disc; a support for said reel comprising a pair of bearing members, the bearing faces of which, respectively, encompass and make sliding contact with a sufficient portion of the perimeters of said end discs so that said end discs are retained by said bearing members for sliding rotational movement of said discs therewithin; a connecting member extending from one of the bearing members to the other and holding the bearing members in fixed position about said disc members; cranking means associated with said discs for rotating said reel within said bearing members; means for attaching a tie rope, cord, strap, or cable to the reel so that said rope, cord, strap, or cable can be wrapped around said shaft when said reel is rotated, to establish and maintain tension in the rope, cord, strap, or cable, and self-locking means adapted to provide a frictional force on the reel, said frictional force being produced at the perimeter of the end discs of the reel as a result of the forced contact of said discs with the bearing faces of said bearing members, said discs having a radius which is at least about 2.5 times the sum of the radius of said elongate shaft and the diameter of said tie rope, cord, strap, or cable, so that the frictional force exerted on the reels produces a torque in said reel which is at least equivalent to the torque on said reel resulting from the tension in the tie rope, cord, strap, or cable.

2. A device in accordance with claim 1 wherein the connecting member forms a yoke extending from the perimeter of one bearing member to the corresponding perimeter of the other bearing member.

3. A device in accordance with claim 1 wherein the bearing members comprise elongate tracks which are bent back upon themselves, respectively, to form circular loops, the inward facing surfaces of which comprise the bearing faces which encompass and make sliding contact, respectively, with the portions of the perimeters of said end discs.

4. A device in accordance with claim 3 wherein the ends of the tracks are attached, respectively, to the connecting member.

5. A device in accordance with claim 1 wherein the edges of the respective bearing faces are adapted to provide lateral support to the end discs of the reel thereby restraining the reel from lateral movement with respect to the bearing members.

6. A device in accordance with claim 1 wherein the means for attaching the tie rope, cord, or cable to the reel comprises an opening in one of the end discs thereof adjacent the elongate shaft, whereby the free end of the tie rope, cord, or cable is inserted through said opening from the inside of said reel, so that when the reel is rotated with the cranking means, the tie rope, cord, or cable is wrapped around the shaft of said reel.

7. A device in accordance with claim 1 wherein means are provided for securing the connecting member to a base or support to which the tie rope, cord, or cable is to be anchored.

* * * * *